US006491517B2

(12) United States Patent
Freeman et al.

(10) Patent No.: US 6,491,517 B2
(45) **Date of Patent: *Dec. 10, 2002**

(54) DECORATIVE CANDLE DISPLAY AND METHOD OF FORMATION

(76) Inventors: Faith Freeman, 19582 Cloverwood Cir., Huntington Beach, CA (US) 92648; Frank H. Asbury, 144 Trevor St., Anaheim, CA (US) 92806

( * ) Notice: Subject to any disclaimer, the term of this patent is extended or adjusted under 35 U.S.C. 154(b) by 0 days.

This patent is subject to a terminal disclaimer.

(21) Appl. No.: 09/981,273

(22) Filed: Oct. 17, 2001

(65) Prior Publication Data

US 2002/0064743 A1 May 30, 2002

Related U.S. Application Data

(63) Continuation-in-part of application No. 09/968,461, filed on Oct. 1, 2001, which is a continuation of application No. 09/767,211, filed on Jan. 22, 2001, now Pat. No. 6,299,435, which is a continuation of application No. 09/612,782, filed on Jul. 10, 2000, now Pat. No. 6,210,153.

(51) Int. Cl.[7] ..... F23D 13/16
(52) U.S. Cl. ..... 431/291; 431/126; 362/161
(58) Field of Search ..... 431/291, 289, 431/288, 126; 44/275, 265; 264/271.1, 279.1, 275, 274; 425/803; 362/161, 810

(56) References Cited

U.S. PATENT DOCUMENTS

| | | | | | |
|---|---|---|---|---|---|
| 2,157,625 | A | * | 5/1939 | Page | 44/275 |
| 3,741,711 | A | * | 6/1973 | Bryant | 431/291 |
| 3,983,677 | A | | 10/1976 | Lundbom | 425/803 |
| 4,225,552 | A | | 9/1980 | Chang | 431/288 |
| 4,332,548 | A | | 6/1982 | Linton et al. | 431/289 |
| 4,427,366 | A | | 1/1984 | Moore | 431/291 |
| D293,823 | S | | 1/1988 | Fieschi et al. | D26/6 |
| 4,820,876 | A | * | 4/1989 | Nuttens et al. | 568/494 |
| 4,826,428 | A | | 5/1989 | Lam | 431/291 |
| 4,894,008 | A | | 1/1990 | Lee | 431/290 |
| 5,395,233 | A | | 3/1995 | Karp | 431/289 |
| 5,578,089 | A | | 11/1996 | Elsamaloty | 44/275 |
| 5,583,853 | A | | 12/1996 | Giallorenzi et al. | |

(List continued on next page.)

FOREIGN PATENT DOCUMENTS

| | | |
|---|---|---|
| DE | 2651035 | 5/1978 |
| JP | 8157864 | 6/1996 |
| JP | 8212818 | 8/1996 |
| JP | 10244800 | 9/1998 |
| JP | 10308110 | 11/1998 |

*Primary Examiner*—Henry Bennett
*Assistant Examiner*—Josiah C. Cocks
(74) *Attorney, Agent, or Firm*—Stetina Brunda Garred & Brucker

(57) ABSTRACT

A decorative candle display including a transparent container with an interior wall surface having flat interior side wall surfaces. There is at least one shaped generally opaque structure fabricated of an opaque combustible wax material and a transparent combustible gelatinous material which is pressed against the interior wall. The generally opaque structure has a tacky surface that self adheres to the interior wall surface. An opaque combustible filler material is disposed within the container and visible therethrough, and a wick extends exteriorly from the filler material. Pigment and/or fragrance can be incorporated within the gelatinous and/or filler materials. The candle display is formed by positioning the at least one opaque structure onto the interior wall, pouring a heat-melted opaque combustible filler material into the container and surrounding a previously placed wick, and finally cooling and solidifying the filler material to thereby complete the candle display.

18 Claims, 4 Drawing Sheets

U.S. PATENT DOCUMENTS

| | | | | |
|---|---|---|---|---|
| 5,632,615 | A | | 5/1997 | DeGarmo ..... 431/288 |
| 5,697,694 | A | | 12/1997 | Cutts ..... 362/161 |
| 5,879,694 | A | | 3/1999 | Morrison et al. ..... 431/288 |
| 5,927,965 | A | | 7/1999 | Pappas ..... 431/289 |
| 6,033,210 | A | | 3/2000 | Freeman ..... 431/291 |
| 6,036,042 | A | * | 3/2000 | Pietruch et al. ..... 220/62.12 |
| D424,719 | S | | 5/2000 | Freeman ..... D26/20 |
| 6,068,472 | A | | 5/2000 | Freeman et al. ..... 431/291 |
| 6,186,776 | B1 | * | 2/2001 | Myerchin ..... 431/289 |
| 6,210,153 | B1 | * | 4/2001 | Freeman et al. ..... 431/291 |

* cited by examiner

DECORATIVE CANDLE DISPLAY AND METHOD OF FORMATION

CROSS-REFERENCE TO RELATED APPLICATIONS

This Application is a continuation-in-part of U.S. patent application Ser. No. 09/968,461, filed Oct. 1, 2001, which is a continuation of U.S. patent application Ser. No. 09/767,211, filed Jan. 22, 2001 now U.S, Pat No. 6,299,435, which is a continuation of U.S. patent application Ser. No. 09/612,702, filed Jul. 10, 2000, now U.S. Pat. No. 6,210,153.

STATEMENT RE: FEDERALLY SPONSORED RESEARCH/DEVELOPMENT (Not Applicable)

BACKGROUND OF THE INVENTION

The present invention relates in general to decorative candles, and in particular to a.decorative candle display including a transparent container, shaped generally opaque structures fabricated of an opaque combustible wax material plus a transparent combustible gelatinous material, the generally opaque structures disposed against the transparent container, and a wicked and opaque combustible filler material disposed within the container, wherein the generally opaque structures are sufficiently tacky to adhere to a flat interior container wall surface for a sufficient amount of time to allow the filler material to be poured so that the opaque structures are captured and held in place against the wall and wherein a gelatinous liner is used to adhere the generally opaque structures to curved interior wall surfaces.

Candles have become very popular for decorative purposes, and as such are produced in different styles, shapes, and colors, with one particular decorative presentment found in candle displays incorporating transparent containers in which candle products are housed for viewing. Such candle products typically are formed of an opaque wax material, such as paraffin, vegetable wax or beeswax, or of a transparent gelatin material such as a mineral oil gel, with a pigment and/or a fragrance optionally included within either material. Additionally, as shown in Applicant's U.S. Pat. No. 6,033,210, issued Mar. 7, 2000, a candle display is provided where transparent combustible gelatinous shaped structures are situated directly against an interior wall of a transparent container which is filled with an opaque combustible filler material that maintains the shaped structures against the interior wall for external visibility.

While the above-described display that includes opaque filler material plus discrete gelatinous structures permits some visual appreciability of gel, the gel presence at the container wall is restricted, particularly in curved shaped containers.

An object of the present invention is to provide a decorative candle display wherein shaped generally opaque structures fabricated of an opaque combustible wax material and a transparent combustible gelatinous material are disposed and retained against the inside of a transparent container with substantially flat interior wall surfaces through adhesive interaction of the gelatinous material and the material of the transparent container, for example glass.

Yet another object of the present invention is to provide a method for producing a decorative candle display as defined above wherein gelatinous material appearance is further enhanced through incorporation of glitter particulate disbursed throughout the gelatinous liner.

These and other objects of the present invention will become apparent throughout the description thereof which now follows.

BRIEF SUMMARY OF THE INVENTION

The present invention is a decorative candle display first including a transparent container with an open top and an interior wall surface having a plurality of flat interior side walls. Situated against the interior wall surface is at least one shaped generally opaque structure fabricated of an opaque combustible wax material and a transparent combustible gelatinous material. An opaque combustible filler material is disposed within the container interiorly from the liner and visible therethrough, and a wick extends exteriorly from the filler material. Pigment and/or fragrance can be incorporated within the gelatinous and/or filler materials.

The candle display is formed by fabricating at least one shaped, generally opaque structure fabricated of an opaque, preferably pigmented, combustible wax material and a transparent combustible gelatinous material and disposing the at least one structure on the interior wall of a transparent container having flat interior side wall surfaces. Finally, an opaque combustible filler material with or without pigment and/or fragrance is heated to its melting temperature, which is less than the melting temperature of the gelatinous material, and poured into the container and surrounding a previously placed wick. The filler material then cools and solidifies, and construction of the candle display is thus completed.

BRIEF DESCRIPTION OF THE DRAWINGS

An illustrative and presently preferred embodiment of the invention is shown in the accompanying drawings in which.

DETAILED DESCRIPTION OF THE INVENTION

Figure 3:
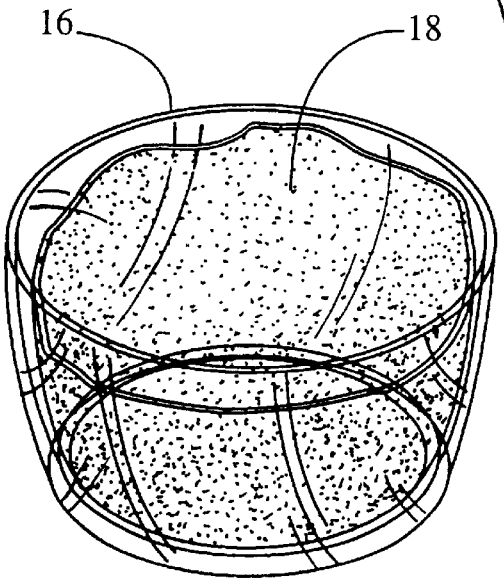

Referring to FIGS. 1–5, a decorative candle display 10 is shown. The candle display 10 is formed by heating a transparent combustible gelatinous material 12, preferably a mineral oil gel, having a plurality of glitter particles 14 disbursed therein, to its melting temperature and pouring it into a transparent container 16. While still in its molten state, the gelatinous material 12 is spread upon the interior walls of the container 16 by hand-rotating the container 16 to thereby coat the walls as a gelatinous material liner 18. Once so coated, any excess of gelatinous material 12 is poured from the container 16 and the gelatinous material 12 is cooled to solidify as a gelatinous liner 18 as illustrated in FIG. 3.

Figure 4:
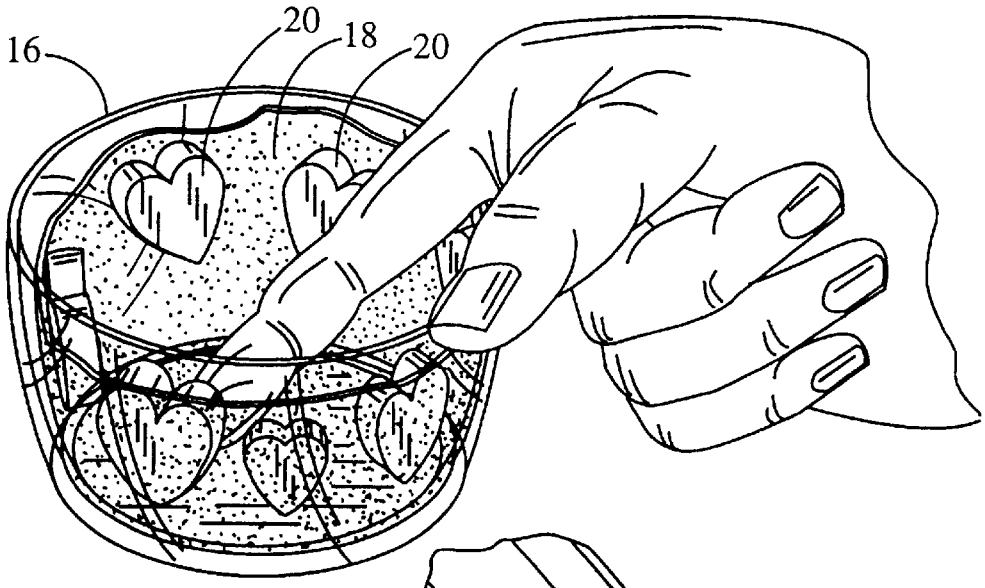

After the liner 18 is formed, at least one, and preferably a plurality of, shaped generally opaque structure 20, as exemplified in the drawings as a heart shape, is positioned there against by hand as illustrated in FIG. 4 for observability through the transparent container 12 and liner 18. The structure 20 is fabricated of an opaque combustible wax material and a transparent combustible gelatinous material preferably prepared in one of two ways. One such preparation is simply heating the wax material and the gelatinous material to their respective melting temperatures and mixing the two materials preferably along with a pigment. The resulting mixture is allowed to cool into a solid sheet configuration and the structure 20 is cut therefrom in cookie-cutter fashion. The second such preparation first heats the gelatinous material to its melting temperature and then pours it into a sheet configuration for cooling and solidification. Thereafter, the wax material is heated to its melting temperature, which is less than the melting temperature of the gelatinous material, and poured over the gelatinous material sheet to thereby form, upon cooling of the wax material, a two layer sheet of wax material and gelatinous material from which the structure 20 is likewise cut therefrom in cookie-cutter fashion. Under either preparation, because of the presence of the wax material, the structure 20 cuts cleanly and retains its edges crisply. The liner 18 retains the structure 20 because of inherent adherence of gelatinous material to gelatinous material. Either side of a structure 20 prepared as a mixture of gelatinous and wax materials can be held by the liner 18 due to the presence of gelatinous material throughout the mixture. Conversely, in a structure 20 prepared as layers, only the gelatinous layer thereof is retained by the liner 18. In either event, however, the structure 20 stays on the liner 18 without pressure there against.

Figure 1:
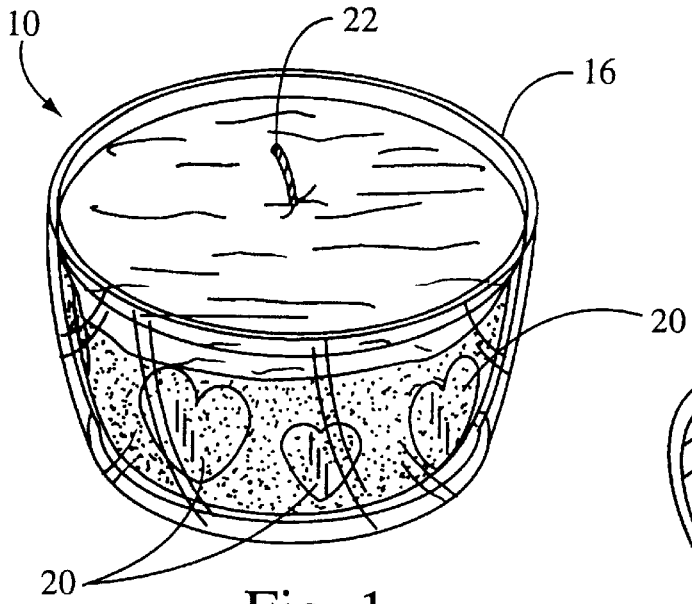
FIG. 1 is a perspective view of a decorative candle display having a container with a curved surface with the interior of the curved surface coated with a gelatinous liner to which decorative structures can be adhered.
Figure 2:
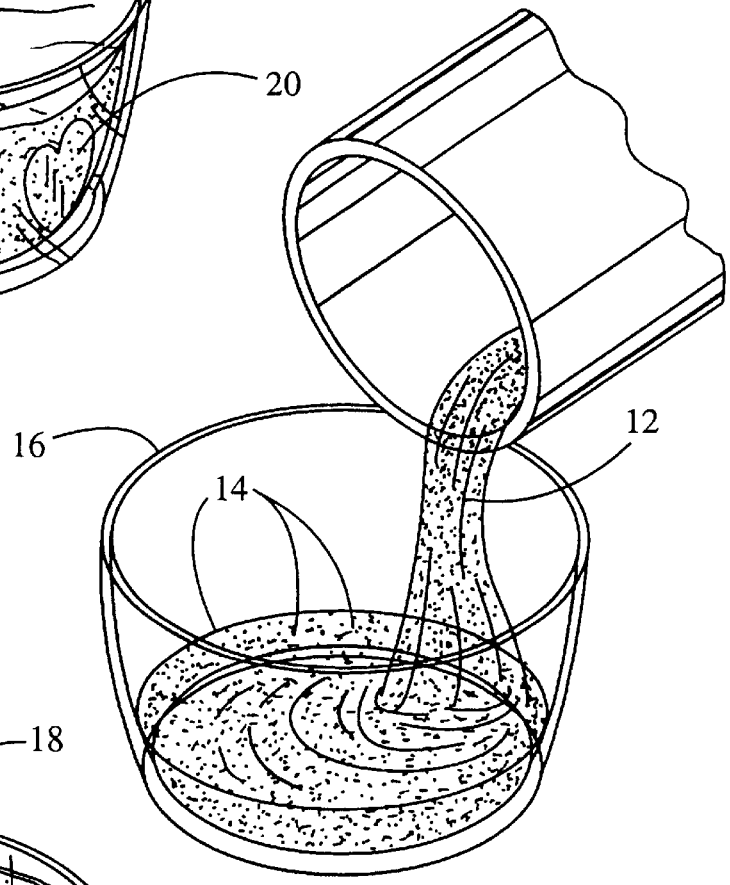
FIGS. 2–5 are perspective views of fabrication steps of the decorative candle display of FIG. 1.
Figure 5:
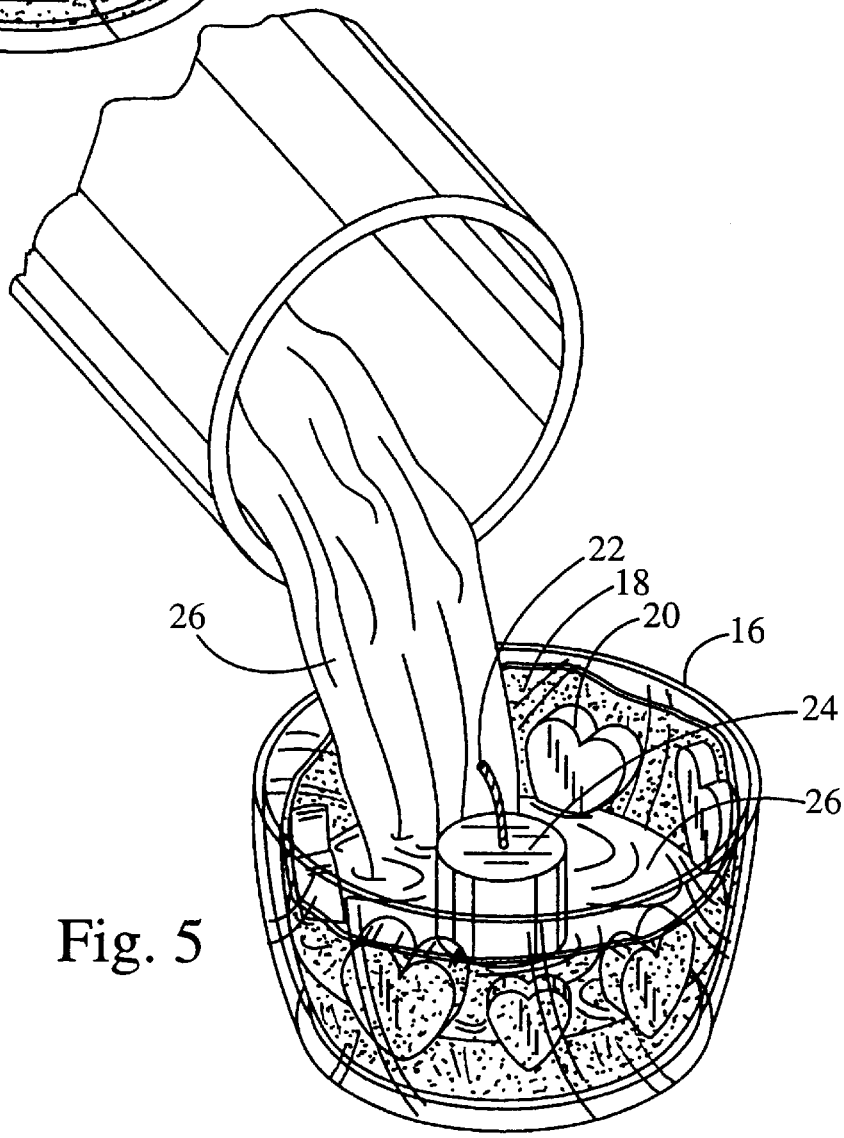
Figure 8:
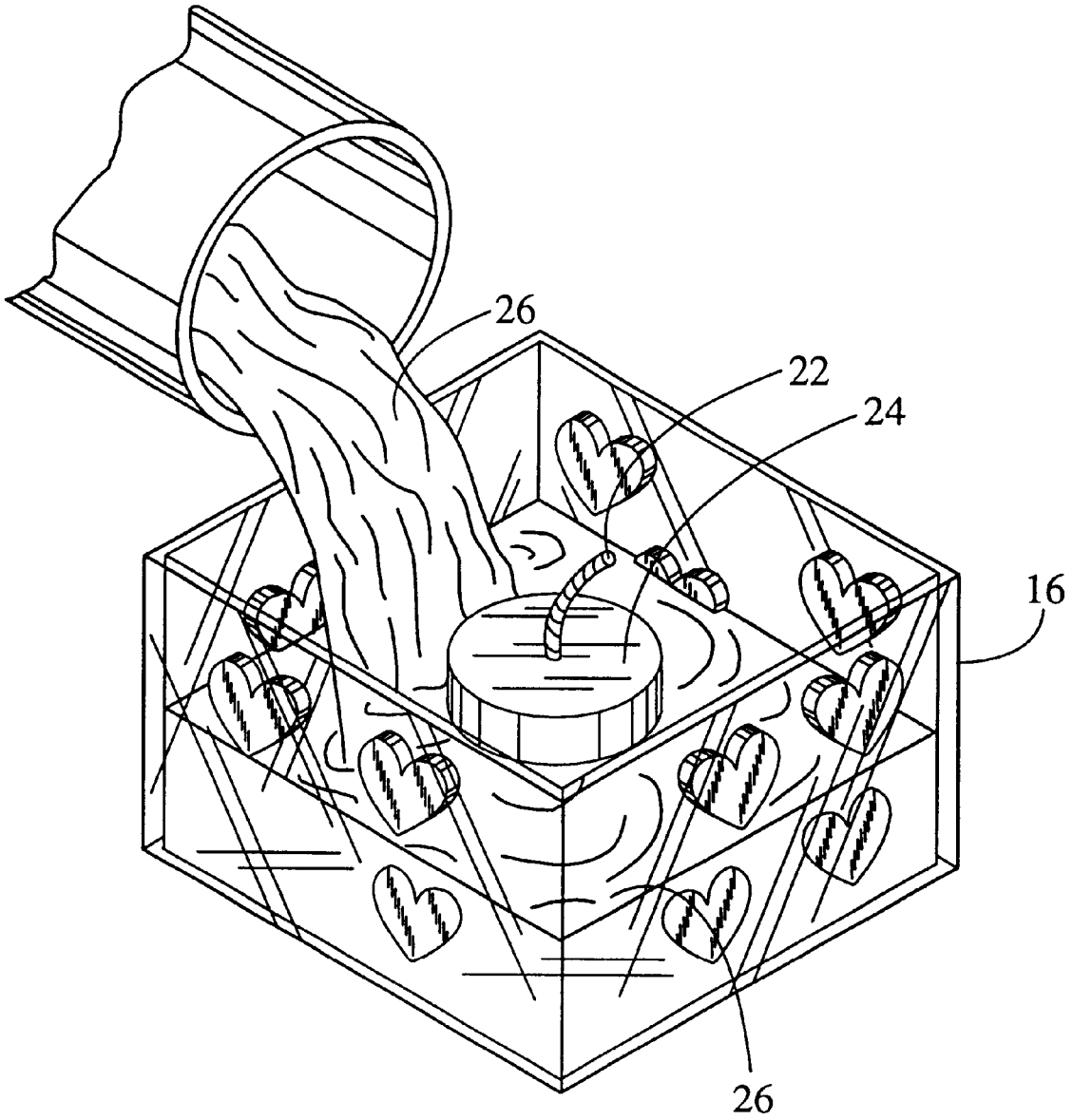

As shown in FIGS. 1 and 5, a wick 22 is provided. One expedient manner in which the wick 22 can be supplied is by placing a standard votive-type candle 24 in the container 12, as shown in FIG. 8, and thereafter filling the container 12 with a combustible filler material 26 which preferably is paraffin. Pourable preparation is accomplished by heating an opaque combustible filler material 26 to its melting temperature, which is less than the melting temperature of the gelatinous material, and pouring it into the container 12 interiorly of the gelatinous liner 18 and surrounding the candle 24 and thus the wick 22. The filler material 26 is thereafter cooled to solidification, and the decorative candle display 10 is completed. Because of the interiorly coated gelatinous liner 18, which is not apparent as a separate component in the finished display 10, the shaped generally opaque structures 20 and the filler material 26 visible through the transparent container 12 appear exceptionally lustrous, while the preferably included glitter particles 14 function to impart an aesthetically pleasing unique presentation.

Figure 6:
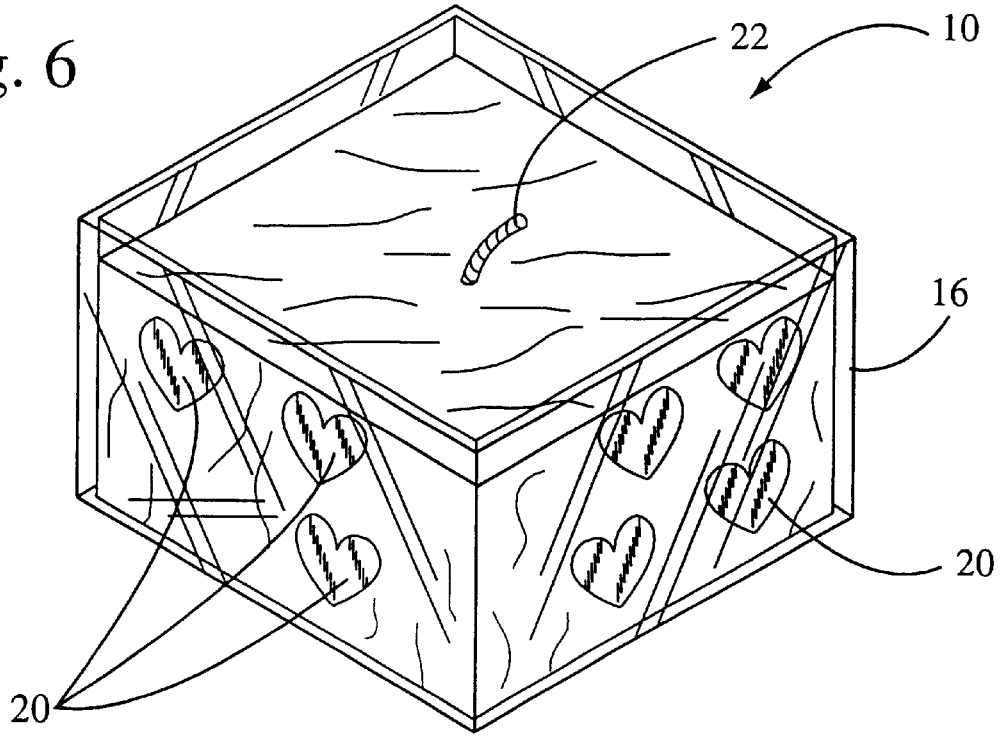
FIG. 6 is a perspective view of an alternative embodiment of a decorative candle display having a container with substantially flat interior wall surfaces on which decorative components having a tacky surface can self-adhere to the flat surface without requiring a gelatinous liner.
Figure 7:
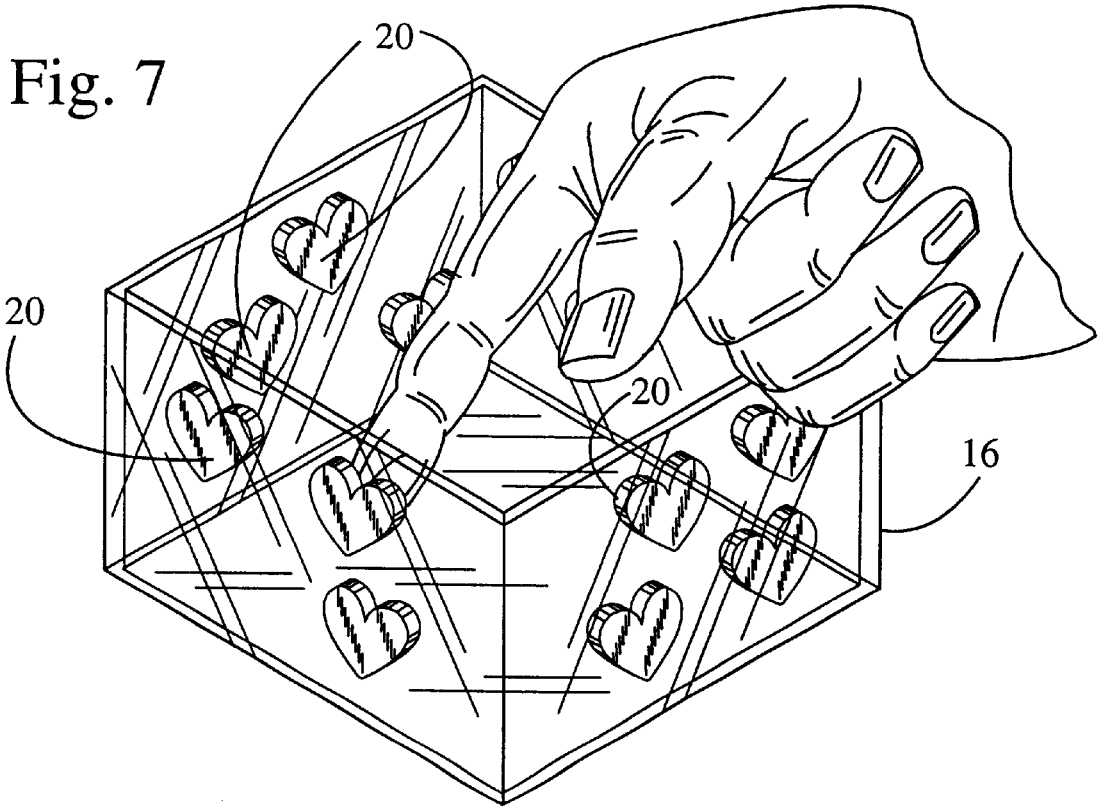
FIGS. 7–8 are perspective views of fabrication steps of the decorative candle display of FIG. 6.

Referring to FIGS. 6–8, an alternative embodiment of a decorative candle display 10 is shown. The candle display 10 shown in FIG. 6 includes a transparent container 16 having a shape comprised of a plurality of substantially flat side wall surfaces. For example, the container may be in the shape of a square as shown in the figures. The container may also be in the shape of a triangle, a rectangle, a hexagon, an octagon, or any other geometric figure having flat sides.

At least one, and preferably a plurality of, shaped generally opaque structures 20, as exemplified in the drawings as a heart shape, is positioned against the substantially flat interior wall surface of the container as shown in FIG. 7. As described above, the structure 20 is fabricated of an opaque combustible wax material and a transparent combustible gelatinous material. The material of the structure is a tacky substance that temporarily self adheres to the surface of the container 16. The structure adheres for a period of time sufficient to complete the other manufacturing steps described above, namely, providing a wick 22 and thereafter filling the container 12 with a combustible filler material 26 as shown in FIG. 8. The filler material 26 is preferably paraffin, but may be other materials, such as vegetable wax, beeswax, or a combinations thereof. The filler material 26 is thereafter cooled to solidification, and the decorative candle display 10 is completed.

Since a liner is not required for containers having flat interior side walls, if a glitter effect as described above with references to FIGS. 1–5 is desired, glitter particles may be added to the filler material. Glitter particles may also be added to the gelatinous structures, if desired.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A decorative candle display comprising:

a) a transparent container with an interior wall surface comprising a plurality of substantially flat side surfaces;

c) at least one shaped generally opaque structure disposed against a respective one of the flat side surfaces of the interior wall surface, the generally opaque structure having a tacky surface and being fabricated of an opaque combustible wax material and a transparent combustible gelatinous material;

d) an opaque combustible filler material disposed within the container; and e) a wick extending from the filler material.

2. The decorative candle display as recited in claim 1 wherein in the at least one shaped generally opaque structure the combustible wax material is a first layer and the gelatinous material is a second layer atop the first layer, with said second layer disposed against the respective one of the flat side surfaces.

3. The decorative candle display as recited in claim 2 wherein the wax material has generally uniformly disbursed therein a pigment.

4. The decorative candle display as recited in claim 1 wherein in the at least one shaped generally opaque structure said structure is fabricated of a mixture of the combustible wax material and the gelatinous material.

5. The decorative candle display as recited in claim 4 wherein the mixture has generally uniformly disbursed therein a pigment.

6. The decorative candle display as recited in claim 1 wherein the opaque combustible filler material is a wax material.

7. The decorative candle display as recited in claim 1 wherein the filler material has generally uniformly disbursed therein a pigment.

8. The decorative candle display as recited in claim 1 wherein the filler material has therein a fragrance.

9. The decorative candle display as recited in claim 1 wherein the wick is anchored in a core candle structure surrounded by the filler material.

10. A method of forming a decorative candle display comprising the steps of:

a) positioning at least one shaped generally opaque structure against a flat interior wall surface of a transparent container, said structure fabricated of an opaque combustible wax material and a transparent combustible gelatinous material, said structure having a tacky surface for adhering to the flat interior wall surface of the container; and b) heating an opaque combustible filler material to its melting temperature, said melting temperature being less than the melting temperature of the gelatinous material, providing a wick extending from within the container, pouring the filler material into the container and surrounding the wick while said structure remains adhered to the flat interior wall surface of the container, and permitting said filler material to cool and solidify.

11. The method of forming a decorative candle display as recited in claim 10 wherein in the at least one shaped generally opaque structure the combustible wax material is a first layer and the gelatinous material is a second layer atop the first layer, with said second layer positioned against the flat interior wall surface.

12. The method of forming a decorative candle display as recited in claim 11 wherein in the at least one shaped generally opaque structure the combustible wax material has generally uniformly disbursed therein a pigment.

13. The method of forming a decorative candle display as recited in claim 10 wherein in the at least one shaped generally opaque structure said structure is fabricated of a mixture of the combustible wax material and the gelatinous material.

14. The method of forming a decorative candle display as recited in claim 13 wherein the mixture has generally uniformly disbursed therein a pigment.

15. The method of forming a decorative candle display as recited in claim 10 wherein the opaque combustible filler material is a wax material.

16. The method of forming a decorative candle display as recited in claim 10 wherein the filler material has generally uniformly disbursed therein a pigment.

17. The method of forming a decorative candle display as recited in claim 10 wherein the filler material has therein a fragrance.

18. The method of forming a decorative candle display as recited in claim 10 wherein the wick is anchored in a core candle structure surrounded by the filler material.

* * * * *